US006518684B1

(12) United States Patent
Schaich et al.

(10) Patent No.: US 6,518,684 B1
(45) Date of Patent: Feb. 11, 2003

(54) DEVICE HAVING A MAGNETIC CLUTCH AND USE THEREOF FOR A GEAR PUMP

(75) Inventors: Martin Schaich, Schlieren (CH); Felix Schnueriger, Gattikon (CH)

(73) Assignee: Maag Pump Systems Textron AG, Zurich (CH)

( * ) Notice: Subject to any disclaimer, the term of this patent is extended or adjusted under 35 U.S.C. 154(b) by 90 days.

(21) Appl. No.: 09/643,736

(22) Filed: Aug. 23, 2000

(30) Foreign Application Priority Data

Nov. 19, 1999 (EP) ..... 99122988

(51) Int. Cl.[7] ..... H02K 49/10; H02P 15/00
(52) U.S. Cl. ..... 310/103; 417/420
(58) Field of Search ..... 310/103, 104, 310/105, 108, 109, 114, 115, 264, 265; 417/420

(56) References Cited

U.S. PATENT DOCUMENTS 1,913,633 A 6/1933 Heil et al. ..... 418/39
4,749,898 A * 6/1988 Suzuki et al. ..... 310/114
4,785,213 A * 11/1988 Satake ..... 310/116
5,165,868 A 11/1992 Gergets et al. ..... 417/366
5,596,238 A * 1/1997 Milnikel ..... 310/103

OTHER PUBLICATIONS

Derwent abstract of Soviet reference 1977SU–2527792, published in Derwent week 8 and 1980, author unknown, month unknown.*

* cited by examiner

*Primary Examiner*—Nestor Ramirez
*Assistant Examiner*—Judson H. Jones
(74) *Attorney, Agent, or Firm*—Crowell & Moring LLP

(57) ABSTRACT

A system has a magnetic coupling for the no-contact transmitting of a torque from a first shaft coupled with a drive unit to a second shaft disposed in a housing. One of the shafts is provided with an inner rotor having magnets and the other shaft is provided with an outer rotor having magnets. The shaft driven by the drive unit is connected in an articulated manner with the drive-side rotor. The axis of the drive-side rotor can be radially fixed by way of fixing elements which can be connected with the housing

8 Claims, 3 Drawing Sheets

DEVICE HAVING A MAGNETIC CLUTCH AND USE THEREOF FOR A GEAR PUMP

The present invention relates to a system according to the preamble of Claim 1 as well as to a use of the system.

Magnetic couplings are used for transmitting the torque between shafts which are not in contact with one another. This means that a rotary transmission to be sealed off, as required, for example, for the drive shaft extending out of the housing in the case of a gear pump, will not be necessary in the case of a gear pump having a magnetic coupling. Pumps driven by means of magnetic couplings have only statically acting seals. They are therefore considered to be hermetically sealed and are suitable particularly for toxic pumping media or pumping media extremely harmful to the environment.

Known magnetic couplings consist of a bell-type outer rotor, the single-walled or double-walled separation pot and the inside rotor. The outer rotor is normally disposed on a motor shaft or a transmission output shaft, and the inner rotor is situated on the drive shaft of the gear pump which extends out of the pump housing. The torque transmission takes place by magnets which are situated on the interior surface of the outer rotor as well as on the exterior surface of the inner rotor. Because of the above-mentioned application advantages, magnetic couplings of this type are used increasingly and preferably also for continuously increasing powers to be transmitted.

A disadvantage of this known embodiment are the high demands made on the position of the components to be mutually connected: Thus, the drive unit as well as the gear pump have to be positioned with respect to one another in an extremely precise manner. Since gear pumps must also be connected with connection pipes for the pumping medium to be transported, further limitations or indications occur here with respect to the desired position which often do not coincide with the former. A remedy is provided here by the possibility that the drive unit can be mounted in a simple manner, which, however, is practical only in the low-power range.

In the case of high transmission powers, the mounting of the magnetic coupling is difficult because the magnets have a very strong—and therefore heavy—construction. The assembling of the components is designed such that the respective last-mounted rotor must be pushed along the separation pot. In this case, the corners of the driving magnets made of a usually brittle magnetic material splinter very easily.

It is therefore an object of the present invention to provide a system which has a magnetic coupling which does not have the above-mentioned disadvantages.

This object is achieved by the measures indicated in the characterizing part of Claim 1. Advantageous embodiments of the invention as well as a use are indicated in additional claims.

The invention has the following advantages: Because the shaft driven by the driving unit is connected in an articulated manner with the drive-side rotor and because the axis of the drive-side rotor is radially fixed by way of fixing elements which are preferably constructed as roller bearings, the axis of the driven shaft and that of the drive-side rotor do not have to coincide. On the contrary, these may have a lacking alignment without any impairment of the functioning of the overall system.

Another embodiment of the invention, in which the bearing points, that is, the roller bearings, are arranged radially with respect to the separation pot of the magnetic coupling, additionally has the advantage that, during the assembly of the magnetic coupling, its outer rotor, guided by the fixing elements, can be pushed over the separation pot without the possibility of a tilting. This embodiment of the invention also has the advantage that the outer rotor bearing is closer to the separation pot and thus to the site where a precise positioning, particularly in the radial direction, is decisive for the functioning.

In the following, the invention will be explained in detail by means of drawings.

Figure 1:
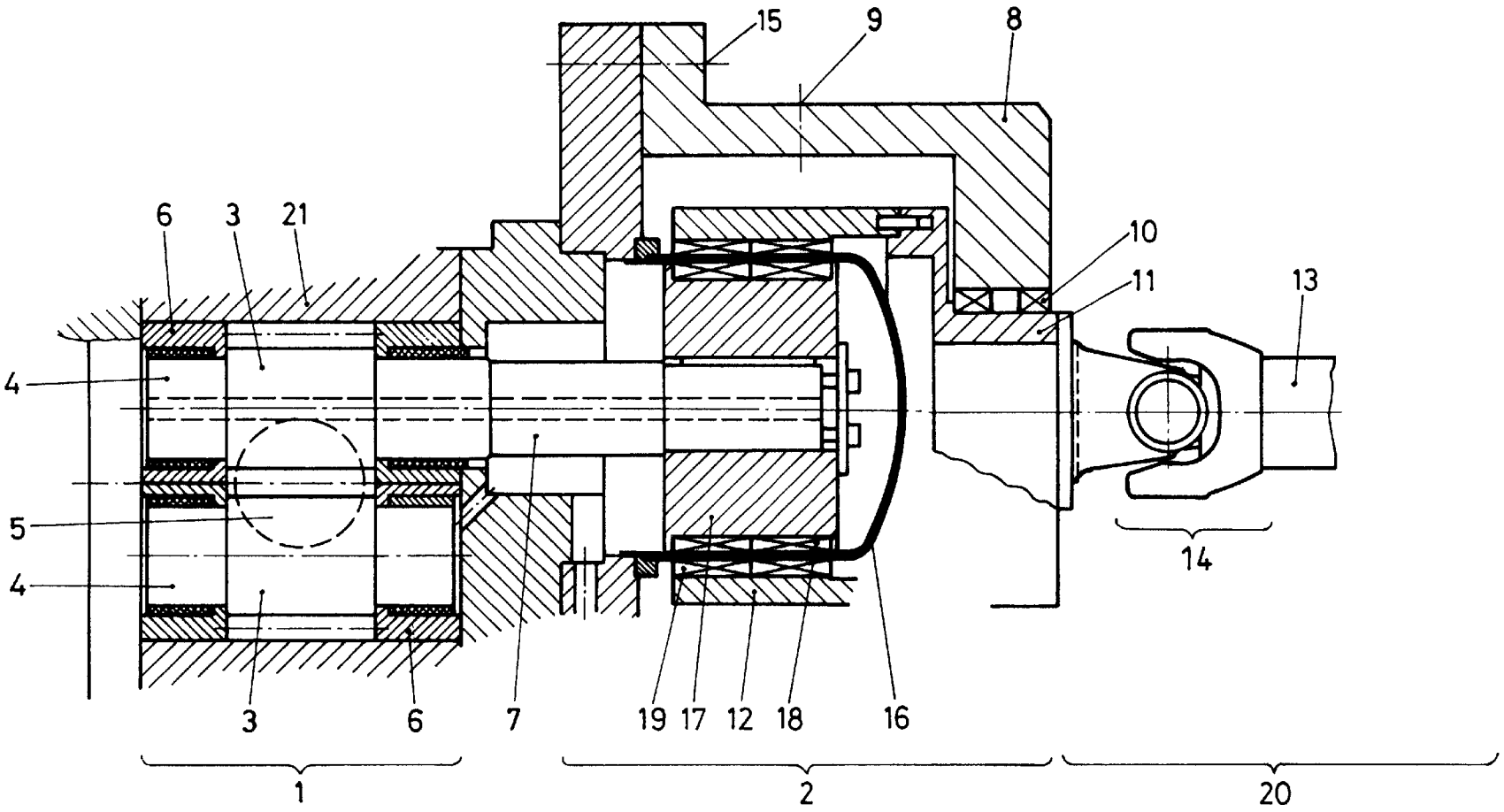
FIG. 1 is a view of a first embodiment of a magnetic coupling according to the invention.

FIG. 1 illustrates a gear pump 1, a magnetic coupling 2 and a universal joint 14 to which a drive unit (not shown in FIG. 1) is connected for driving the gear pump 1.

The gear pump 1 consists essentially of a pump housing 21, of two mutually meshing gears 3 and shaft bearings 6 in which the shafts 4 are disposed which carry the gears 3. One of the shafts 4 extends out of the pump housing 21 for the drive of the pump. On this lengthened shaft, in the following called drive shaft 7, an inner rotor 17 is disposed which is part of the magnetic coupling 2 and which has magnets 18 on its surface. An outer rotor 12 which is also equipped with magnets 19 on this interior surface is arranged radially to the inner rotor 17, in which case a so-called separation pot 16 is provided between the inner and the outer rotor 17 and 12, which separation pot 16 permits a complete sealing. On the drive side, that is, adjoining the outer rotor 12 and connected with the latter, a shaft section 11 is provided which is held in position by way of a fixing element 8 which can be connected with the pump housing 21. This means that the mobility of the shaft section 11—and thus also of the outer rotor 12—is restricted according to the invention in the radial direction to the bearing play of a bearing preferably constructed as a roller bearing 10.

Furthermore, the shaft section 11 is connected by way of a universal joint 14 with a drive shaft 13, that is, preferably first with an interior part of a drive shaft, which interior part is connected by way of a second universal joint (not shown in FIG. 1) with the actual drive shaft of a drive unit (not shown in FIG. 1).

Thus, with respect to the radial mobility, the magnetic coupling 2 forms a unit with the gear pump 1 and with its housing 21, whereby it is advantageously achieved that the drive axis 7 of the gear pump 1 does not have to coincide precisely with the drive axis 13 of the drive unit.

Another advantage is achieved in that at least one of the drive shaft sections, that is, the drive shaft section in front of the first universal joint 14 and/or between the two universal joints and/or behind the second universal joint, has a telescopic construction and can thus be lengthened and shortened according to the requirements. These further embodiments will then permit a still more flexible handling of the positioning of the gear pump with respect to the drive unit.

It is also conceivable to use other types of joints instead of universal joints. It was found that particularly curved-teeth couplings, rubber couplings or other flexible couplings are excellently suitable for implementing the system according to the invention.

The fixing element 8 is fastened on the pump housing 21 by means of releasable fastening devices 15 which preferably consist of screws. In a preferred embodiment, the fixing element 8 is tube-shaped and closes off the magnetic coupling 2 with respect to the outside, in which case ventilation bores 9 are provided.

Figure 2:
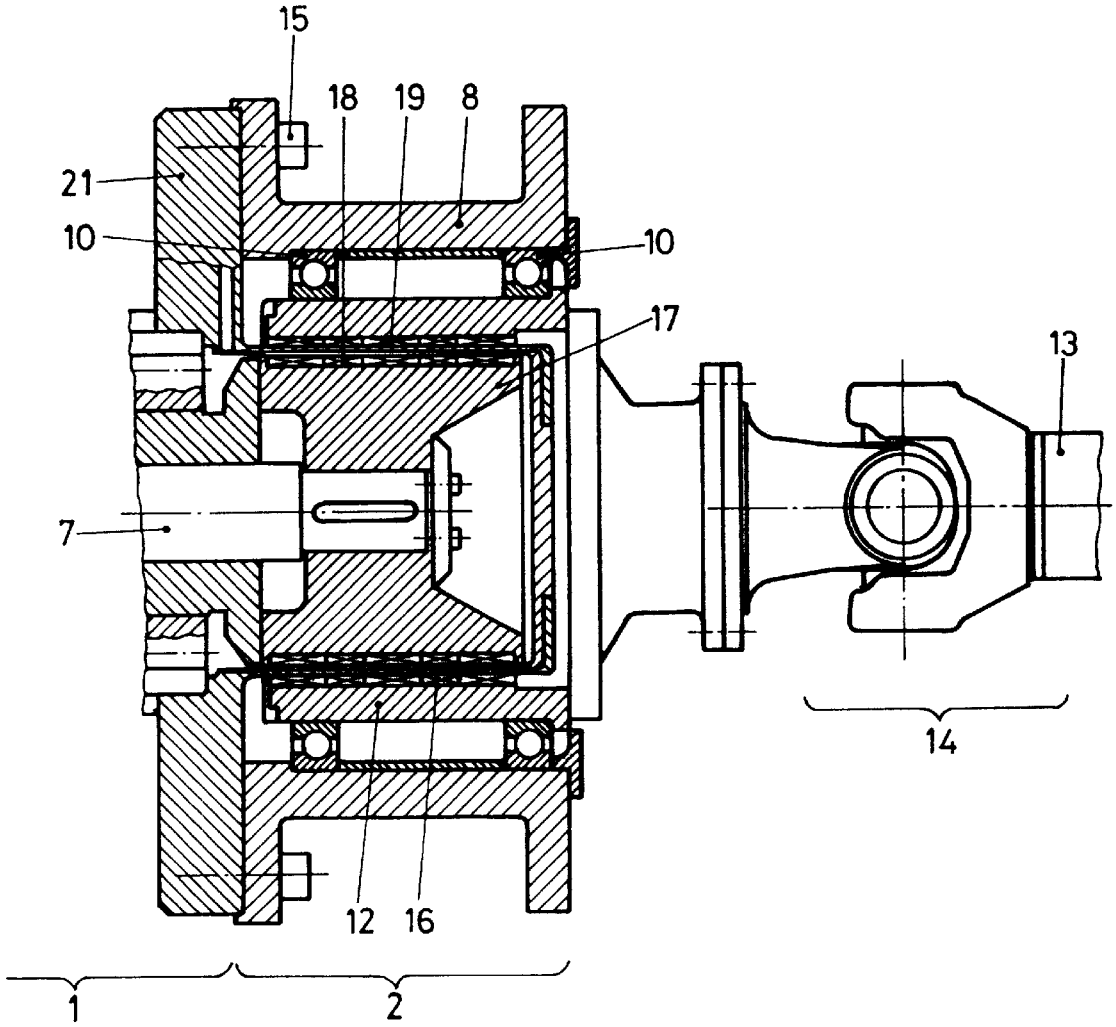
FIG. 2 is a view of another embodiment of the magnetic coupling according to the invention.

FIG. 2 shows another embodiment of the invention in which the roller bearings 10 are arranged radially with respect to the separation pot 16. As a result, the bearing of the outer rotor 12 is situated closer to the separation pot 16 and thus to the site where a precise positioning is decisive for the functioning.

FIG. 2 essentially shows the magnetic coupling 2. Only individual components of the gear pump 21 are shown, specifically the pump housing 21 and cutouts of the shaft passage of the drive shaft 7.

In addition to the mentioned advantage with respect to an ideal force absorption in the case of radially arranged roller bearings 10, the additional embodiment also has the advantage that the assembly can be carried out in a simple manner. Thus, at the conclusion of the assembly, the outer rotor 12 is simply pushed onto the separation pot 16 without touching the separation pot, because the roller bearings 10 have the effect that the magnets 19 of the outer rotor 12 and the separation pot 16 have a permanent spacing.

Figure 3:
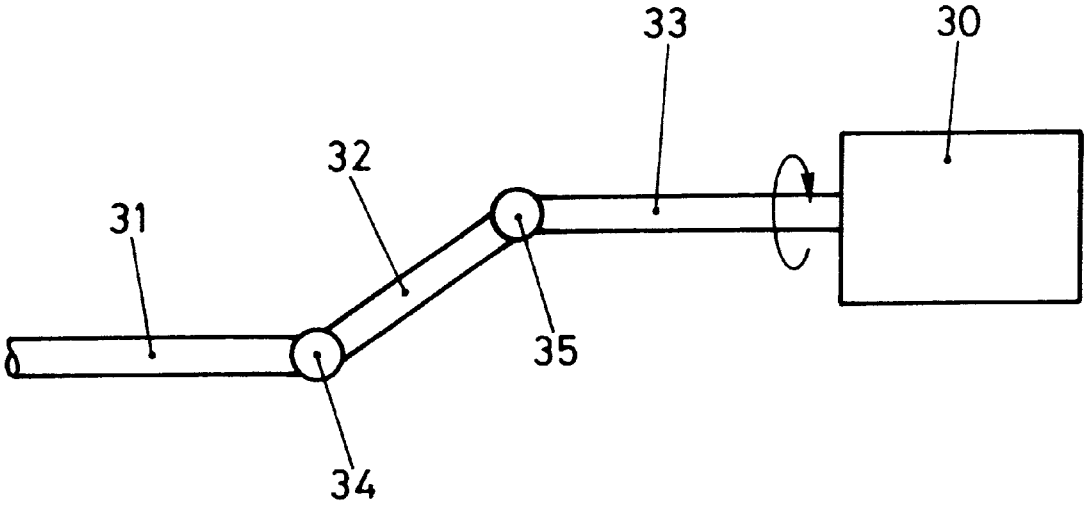
FIG. 3 is a schematic representation of shaft sections of the drive shaft and of a drive unit for driving the shaft.

Finally, FIG. 3 is a schematic representation of three shaft sections 31, 32 and 33 of the drive shaft, the first shaft section 31 being connected with the second shaft section 32 by way of a first flexible coupling 34 and the second shaft section 32 being connected with the third shaft section 33 by way of a second flexible coupling 35. The shaft section 33 corresponds to the rigid drive shaft extending out of the drive unit 30. On the other side, the outer rotor 12 (FIGS. 1 and 2) of the magnetic coupling 2 (FIGS. 1 and 2) is connected with the first shaft section 31. The flexible couplings 34 and 35 are implemented in one of the explained forms.

In a preferred embodiment, the second shaft section 32 has a telescopic construction.

What is claimed is:

1. System comprising a magnetic coupling for non-contact transmission of a torque from a first shaft operatively coupled with a drive unit to a second shaft disposed in a housing, one of the shafts being provided with an inner rotor having magnets and the other of the shafts being provided with an outer, drive-side rotor having magnets, wherein the other of the shafts driven by the drive unit is articulatably connected with the drive-side rotor, the axis of the drive-side rotor is arranged to be radially fixed by a fixing element which is connectable with the housing, and roller bearing units are operatively arranged between the fixing elements and the drive-side rotor and radially with respect to the drive-side rotor.

2. System according to claim 1, wherein the articulatable connection between the drive-side rotor and the other of the shafts is at least one flexible coupling.

3. System according to claim 2, wherein the at least one flexible coupling is one of a rubber coupling, a curved tooth coupling, a universal joint and a combination of two or more of more of the above-mentioned couplings.

4. System according to claim 1, wherein the fixing element is tube-shaped.

5. System according to claim 4, wherein at least one ventilation bore is provided in the fixing element.

6. System according to claim 1, wherein the drive shaft comprises a shaft section having a telescopic construction.

7. System according to claim 1, wherein a separation pot is operatively arranged between the inner rotor and the outer rotor to provide a complete sealing.

8. Use of the system according to claim 1, for driving a gear pump.

* * * * *